US010337131B2

(12) United States Patent
Konzak et al.

(10) Patent No.: US 10,337,131 B2
(45) Date of Patent: Jul. 2, 2019

(54) RECONFIGURABLE FABRIC FRAME FOR A MANEUVERABLE SEWING MACHINE

(71) Applicant: HANDI QUILTER, INC., North Salt Lake, UT (US)

(72) Inventors: Gary James Konzak, Salem, UT (US); Gordon Hudson, North Salt Lake, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 267 days.

(21) Appl. No.: 15/594,261

(22) Filed: May 12, 2017

(65) Prior Publication Data

US 2018/0327952 A1 Nov. 15, 2018

(51) Int. Cl.
*D05B 39/00* (2006.01)
*D05B 11/00* (2006.01)

(52) U.S. Cl.
CPC ..... *D05B 39/005* (2013.01); *D05B 11/00* (2013.01)

(58) Field of Classification Search
CPC ..... D05B 75/00; D05B 11/00; D05B 39/00; D05B 39/005
USPC ..... 112/117, 118, 119, 258, 260
See application file for complete search history.

(56) References Cited

U.S. PATENT DOCUMENTS 334,646 A * 1/1886 Davis ..... D05B 11/00 112/119
453,179 A * 6/1891 Davis ..... D05B 11/00 112/119
672,809 A * 4/1901 Russell ..... D05C 1/02 38/102.21
1,724,215 A * 8/1929 Moran ..... A47B 29/00 248/164
4,192,241 A * 3/1980 Reed ..... D05B 11/00 112/117
4,665,638 A * 5/1987 Morton ..... D05C 1/02 242/538
5,870,840 A * 2/1999 Geils ..... D05C 1/02 38/102.21
6,151,816 A * 11/2000 Bagley ..... D05C 1/02 38/102.21
6,615,756 B2 * 9/2003 Barrus ..... D05B 11/00 112/119
6,631,688 B1 * 10/2003 Maag ..... D05B 11/00 112/118
6,757,996 B1 * 7/2004 Bellavich ..... D05B 39/005 38/102.21

(Continued)

*Primary Examiner* — Danny Worrell
(74) *Attorney, Agent, or Firm* — Maschoff Brennan

(57) ABSTRACT

Reconfigurable fabric frame for a maneuverable sewing machine. In one example embodiment, an example reconfigurable fabric frame may include a take-up pole, an idler pole, a backing pole, a quilt-top pole, and side rails. The side rails may include take-up pole attachment locations, idler pole attachment locations, backing pole attachment locations, and quilt-top pole attachment locations. The side rails may be reconfigurable between a first configuration and a second configuration. In the first configuration, the backing pole attachment locations may be higher than the quilt-top pole attachment locations. In the second configuration, the backing pole attachment locations may be lower than the quilt-top pole attachment locations.

19 Claims, 7 Drawing Sheets

(56) References Cited

U.S. PATENT DOCUMENTS

| | | | | |
|---|---|---|---|---|
| 6,792,884 | B1 * | 9/2004 | Barrus | D05B 11/00 112/119 |
| 6,951,178 | B2 * | 10/2005 | Watts | D05B 11/00 112/118 |
| 6,990,914 | B2 * | 1/2006 | Canan | D05B 11/00 112/119 |
| 7,011,031 | B1 * | 3/2006 | Bradley | D05B 11/00 112/119 |
| 7,552,691 | B1 * | 6/2009 | Martelli | D05B 3/24 112/117 |
| 7,854,208 | B1 * | 12/2010 | Martelli | D05B 75/00 112/117 |
| 9,963,812 | B2 * | 5/2018 | Roche | D05B 11/00 |
| 2009/0229389 | A1 * | 9/2009 | Bowers | D05B 11/00 74/89.45 |

* cited by examiner

RECONFIGURABLE FABRIC FRAME FOR A MANEUVERABLE SEWING MACHINE

FIELD

The embodiments disclosed herein relate to a reconfigurable fabric frame for a maneuverable sewing machine.

BACKGROUND

Sewing machines generally function by reciprocating a threaded needle into and out of one or more layers of fabric to form a row of stitches in the fabric. While some sewing machines are operated in a stationary fashion while the fabric is repositioned underneath the needle, other sewing machines are operated in a maneuverable fashion by repositioning the needle while the fabric remains stationary. When operated in this maneuverable fashion, the fabric is typically mounted on a fabric frame.

One difficulty encountered with fabric frames for maneuverable sewing machines is sewing a row of stitches along a predetermined path on the fabric during operation of the sewing machine. Where the sewing machine is able to be maneuvered in any direction on the fabric frame, it can be difficult for a user to guide the needle of the maneuverable sewing machine precisely along a path where the user desires to form a row of stitches without straying from the path.

The subject matter claimed herein is not limited to embodiments that solve any disadvantages or that operate only in environments such as those described above. Rather, this background is only provided to illustrate one example technology area where some embodiments described herein may be practiced.

SUMMARY

In general, example embodiments described herein relate to a reconfigurable fabric frame for a maneuverable sewing machine. In some embodiments, an example reconfigurable fabric frame may include a take-up pole, an idler pole, a backing pole, a quilt-top pole, and side rails. The side rails may include take-up pole attachment locations, idler pole attachment locations, backing pole attachment locations, and quilt-top pole attachment locations. The side rails may be reconfigurable between a first configuration and a second configuration. In the first configuration, the backing pole attachment locations may be higher than the quilt-top pole attachment locations. In the second configuration, the backing pole attachment locations may be lower than the quilt-top pole attachment locations.

In some embodiments, the side rails may include stationary portions and reconfigurable portions. The stationary portions may include the take-up pole attachment locations and the idler pole attachment locations and the reconfigurable portions may include the backing pole attachment locations and the quilt-top pole attachment locations. The reconfigurable portions may be configured, when repositioned between the first configuration and the second configuration, to switch the backing pole attachment locations and the quilt-top pole attachment locations. The backing pole and the quilt-top pole may be configured, when the reconfigurable portions are repositioned between the first configuration and the second configuration, to be detached from the reconfigurable portions and reattached to the switched attachment locations of the reconfigurable portions. The backing pole attachment locations and the quilt-top pole attachment locations may include ratchets configured to apply tension to backing fabric spooled on the backing pole and to quilt-top fabric spooled on the quilt-top pole.

Further, in some embodiments, the reconfigurable portions may be configured to be repositioned between the first configuration and the second configuration by hand and without the use of any tool. The reconfigurable portions may include hand knobs and the reconfigurable portions may be configured to be repositioned between the first configuration and the second configuration by manually loosening the hand knobs, manually shifting the reconfigurable portions between the first configuration and the second configuration, and manually tightening the hand knobs. The stationary portions may include slots through which the hand knobs of the reconfigurable portions extend, and manually shifting the reconfigurable portions between the first configuration and the second configuration may include sliding the hand knobs along the slots.

Also, in some embodiments, while in the first configuration, the top of the backing pole and the bottom of the idler pole may form a plane in which a maneuverable sewing machine is configured to sew. While in the first configuration, the backing pole may be configured to have backing fabric spooled thereon such that the backing fabric flows from the front of the backing pole, over the top of the backing pole, under a hopping foot of the maneuverable sewing machine, and under the bottom of the idler pole. While in the first configuration, the backing pole may be configured to enable a ruler positioned next to the hopping foot of the maneuverable sewing machine to extend over the top of the backing pole with the ruler positioned flat against a top layer of fabric. While in the second configuration, the quilt-top pole may be configured to have quilt-top fabric spooled thereon such that the quilt-top fabric flows from the front of the quilt-top pole, under the bottom of the quilt-top pole, under a hopping foot of the maneuverable sewing machine, and under the bottom of the idler pole. While in the second configuration, the quilt-top pole may be configured to prevent a ruler positioned next to the hopping foot of the maneuverable sewing machine from extending over the top of the quilt-top pole with the ruler positioned flat against the quilt-top fabric.

Further, in some embodiments, the maneuverable sewing machine may be a long-arm quilting machine.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
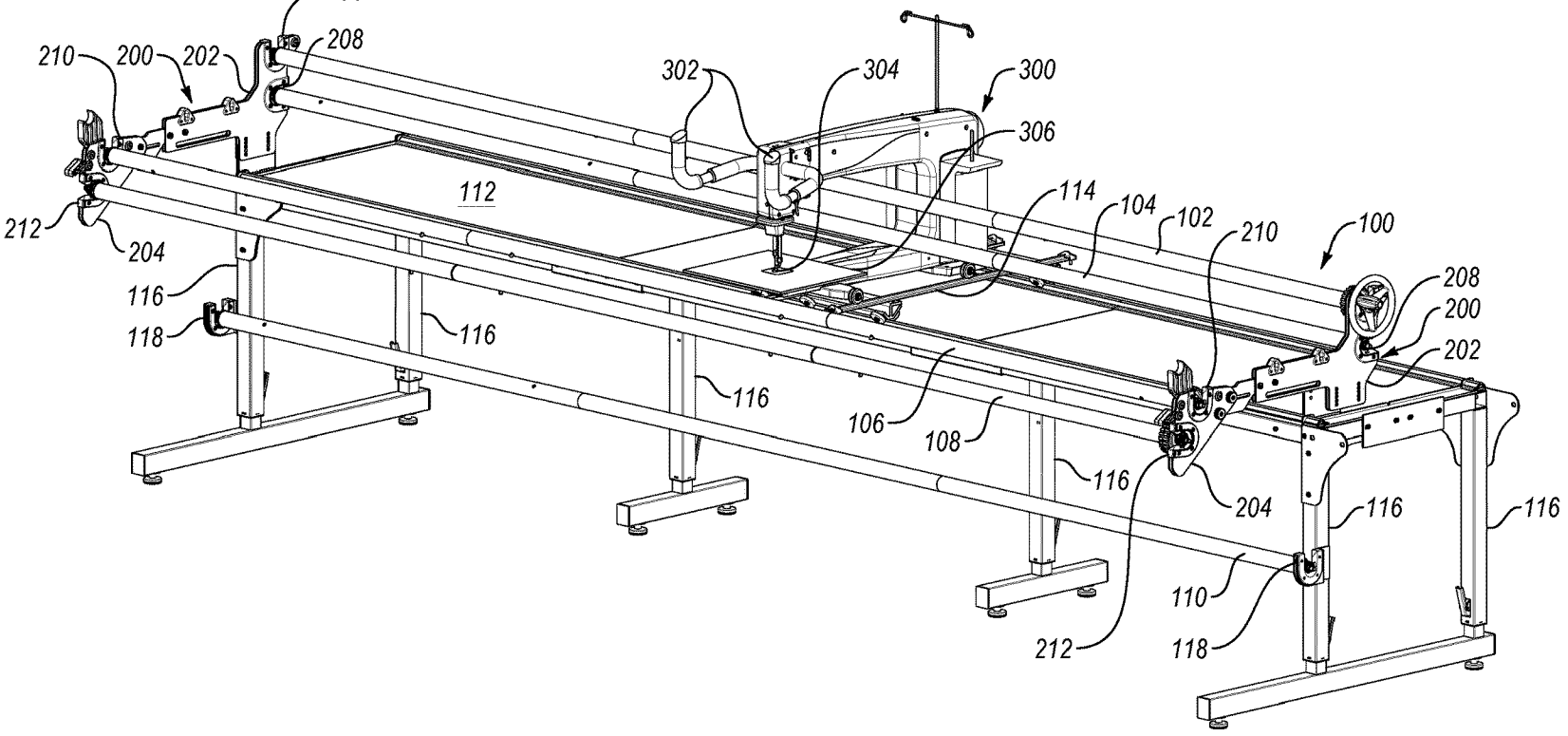
FIG. 1A is a front top perspective view of an example reconfigurable fabric frame for a maneuverable sewing machine in a first configuration.

Some embodiments in this disclosure relate to a reconfigurable fabric frame for a maneuverable sewing machine.

Where a sewing machine is able to be maneuvered in any direction on a fabric frame, it can be difficult for a user to guide a needle of the maneuverable sewing machine precisely along a path where the user desires to form a row of stitches without straying from the path. To help guide the needle, a user may position a ruler against a top layer of the fabric along a path where the user desires to form a row of stitches. The ruler may then help the user avoid straying from the path where the user desires to form the row of stitches. In order for the ruler to be helpful, it may need to remain positioned flat against the top layer of the fabric on the fabric frame.

However, some conventional fabric frame and ruler configurations may prevent a ruler from remaining positioned flat against the top layer of the fabric on the fabric frame. For example, where a fabric frame is configured with a quilt-top spool higher than a backing spool, the quilt-top fabric on the quilt-top spool may be spooled such that the quilt-top pole prevents a ruler positioned flat against the quilt-top fabric from extending over the top of the quilt-top pole. Thus, where a relatively long ruler is too long to fit in a working area of the fabric frame (which is generally defined by the innermost poles of the fabric frame and the sides of the fabric) without extending over the top of the quilt-top pole, the quilt-top pole may prevent the user from benefiting from the assistance of the relatively long ruler during operation of the sewing machine, potentially resulting in the user straying from the path where the user desires to form a row of stitches.

The embodiments disclosed herein may provide various benefits. In particular, the embodiments disclosed herein may, for example, enable use of a ruler that extends over the top of the higher front pole of the reconfigurable quilting frame. This may be accomplished by a reconfigurable quilting frame with first and second configurations.

In some embodiments, in the first configuration, the relative positions of the quilt-top pole and the backing pole may be reversed from conventional fabric frames by positioning the backing pole higher than the quilt-top pole. While in the first configuration, the top of the backing pole and the bottom of the idler pole may form a plane in which a maneuverable sewing machine may be configured to sew. While in the first configuration, the backing fabric may be spooled on the backing fabric such that the backing pole enables a ruler positioned next to a hopping foot of a maneuverable sewing machine to extend over the top of the backing pole with the ruler positioned flat against the backing fabric. Thus, even where a relatively long ruler is too long to fit in a working area of the reconfigurable fabric frame without extending over the top of the backing pole, the backing pole may still enable the user to benefit from the assistance of the relatively long ruler during operation of the sewing machine, potentially resulting in the user being assisted in precisely following a path where the user desires to form a row of stitches.

In some embodiments, in the second configuration, the relative positions of the quilt-top pole and the backing pole match conventional fabric frames by positioning the backing pole lower than the quilt-top pole. In the second configuration, although a user may be prevented from using a relatively long ruler to guide the user in forming a row of stitches along a predetermined path, the second configuration may enable the user to sit closer to the working area of the reconfigurable fabric frame, to more easily avoid bumping portions of the maneuverable sewing machine against the reconfigurable fabric frame, and to more easily access the bobbin of the maneuverable sewing machine. Thus, in situations where the user does not desire the assistance of a relatively long ruler, the second configuration of the reconfigurable fabric frame may be desired over the first configuration of the fabric frame.

Thus, while employing the embodiments disclosed herein, a user may benefit from the option of reconfiguring a reconfigurable fabric frame between a first configuration and a second configuration.

Figure 1B:
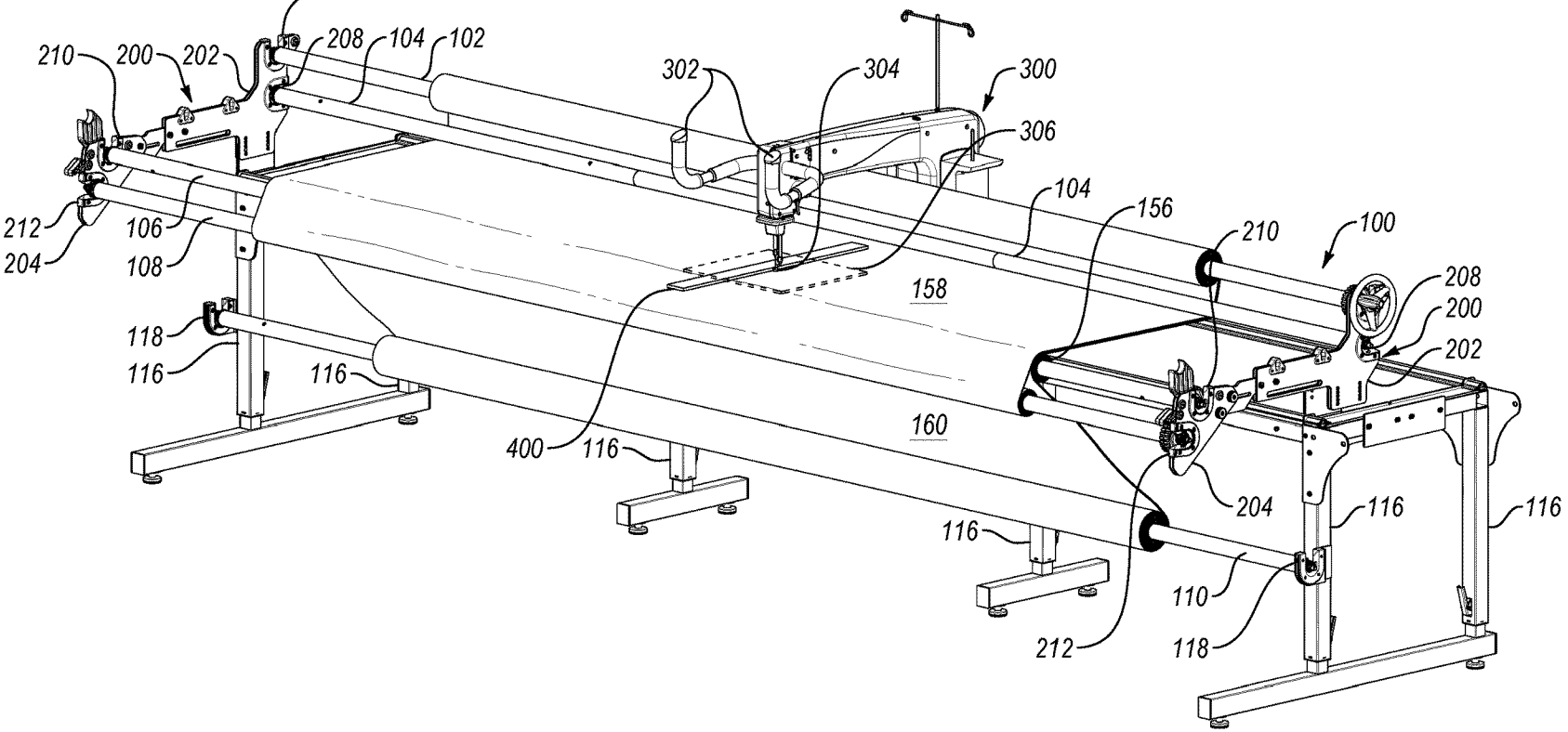
FIGS. 1B-1C are front top perspective views of the example reconfigurable fabric frame of FIG. 1A with fabric spooled thereon.
Figure 1C:
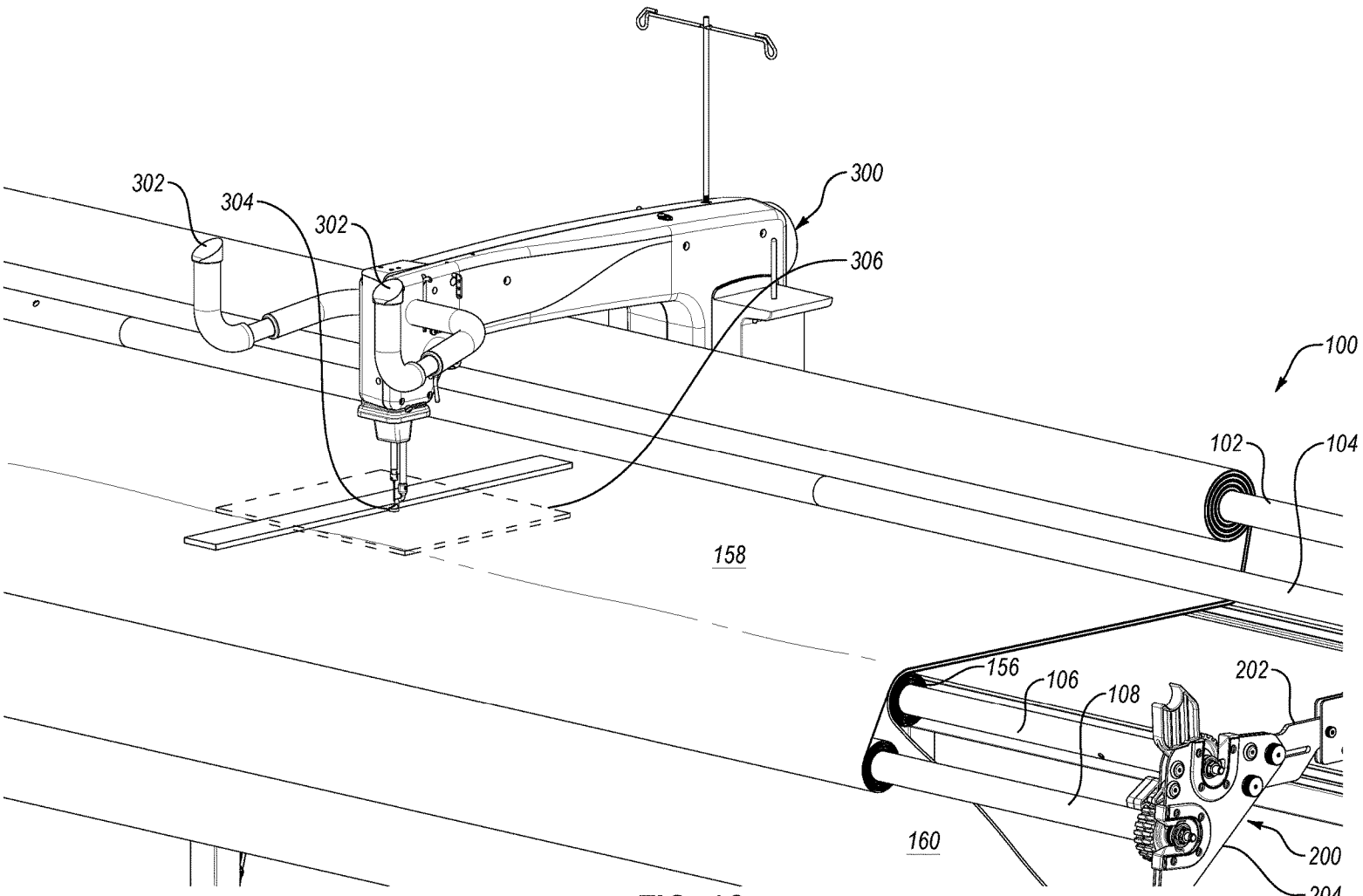

Turning to the figures, FIG. 1A is a front top perspective view of an example reconfigurable fabric frame 100 for a maneuverable sewing machine 300 in a first configuration and FIGS. 1B-1C are front top perspective views of the example reconfigurable fabric frame 100 with fabric spooled thereon.

The maneuverable sewing machine 300 of FIGS. 1A-1C is specialized for quilting and is known as a long-arm quilting machine. A long-arm quilting machine may be distinguished from other types of sewing machines because of the "long-arm" configuration of the machine. A long-arm quilting machine may also include one or more of handlebars 302, a hopping foot 304, and a ruler base 306. Quilting typically involves stitching together multiple layers of fabric to form a quilt. A quilt typically includes a layer of batting fabric sandwiched in between an upper quilt-top fabric and a lower backing fabric. However, although the example maneuverable sewing machine 300 of FIGS. 1A-1C (and FIGS. 2A-2B) is a long-arm quilting machine, it is understood that the maneuverable sewing machine 300 is only one of countless sewing machines in which the example reconfigurable fabric frame 100 may be employed. The scope of the example reconfigurable fabric frame 100 is therefore not intended to be limited to employment with any particular sewing machine.

As disclosed in FIG. 1A, the reconfigurable fabric frame 100 may include a take-up pole 102, an idler pole 104, a backing pole 106, a quilt-top pole 108, a batting pole 110, and side rails 200. The reconfigurable fabric frame 100 may further include a tabletop 112 upon which a carriage 114 is mounted, as well as legs 116 supporting the side rails 200 and the tabletop 112.

In some embodiments, the side rails 200 may include stationary portions 202 and reconfigurable portions 204. The stationary portions 202 may include take-up pole attachment locations 206 and idler pole attachment locations 208. The reconfigurable portions 204 may include backing pole attachment locations 210 and quilt-top pole attachment locations 212. Further, the legs 116 may include batting pole attachment locations 118. In the first configuration, the backing pole attachment locations 210 may be higher than the quilt-top pole attachment locations 212.

Each of the backing pole 106, the quilt-top pole 108, and the batting pole 110 may be configured to have a layer of fabric spooled thereon, and the maneuverable sewing machine 300 may be employed to sew these three layers of fabric together into a quilt that is then spooled on the take-up pole 102. Further, any of the backing pole attachment locations 210, the quilt-top pole attachment locations 212, the batting pole attachment locations 118, and the take-up pole attachment locations 206 may include ratchets configured to apply tension to the fabric spooled on the poles.

For example, while in the first configuration disclosed in FIGS. 1B and 1C, the backing pole 106 may be configured to have backing fabric 156 spooled thereon such that the backing fabric 156 flows from the front of the backing pole 106, over the top of the backing pole 106, under the hopping foot 304 of the maneuverable sewing machine 300, and under the bottom of the idler pole 104. At the same time, the quilt-top pole 108 may be configured to have quilt-top fabric 158 spooled thereon such that the quilt-top fabric 158 flows from the front of the quilt-top pole 108, over the top of the quilt-top pole 108, over the top of the backing pole 106, under the hopping foot 304 of the maneuverable sewing machine 300, and under the bottom of the idler pole 104. Also at the same time, the batting pole 110 may be configured to have batting fabric 160 spooled thereon such that the batting fabric 160 flows from the batting pole 110, between the quilt-top pole 108 and the backing pole 106 (to be sandwiched between the quilt-top fabric 158 and the backing fabric 156), over the top of the backing pole 106, under the hopping foot 304 of the maneuverable sewing machine 300, and under the bottom of the idler pole 104.

In some embodiments, while in the first configuration disclosed in FIGS. 1B and 1C, the top of the backing pole 106 and the bottom of the idler pole 104 may form a plane in which the maneuverable sewing machine 300 is configured to sew. It is understood that this "plane" may actually be raised above the top of the backing pole 106 by the thickness of the backing fabric 156 spooled on the backing pole 106, the thickness of a single layer of the batting fabric 160, and the thickness of a single layer of the quilt-top fabric 158.

Further, in some embodiments, while in the first configuration disclosed in FIGS. 1B and 1C, the backing pole 106 may be configured to enable a ruler 400 to be positioned next to the hopping foot 304 of the maneuverable sewing machine 300. A user may place the ruler 400 against the quilt-top fabric 158 along a path where the user desires to form a row of stitches. The ruler 400 may then help the user avoid straying from the path where the user desires to form the row of stitches. In order for the ruler 400 to be helpful, it may need to remain positioned flat against the quilt-top fabric 158 on the reconfigurable fabric frame 100. The ruler base 306, which is positioned beneath the layers of fabric on the reconfigurable fabric frame 100, may at least partially support the ruler 400. The ruler base 306 may help keep the ruler 400 from distorting the layers of fabric due to the weight of the ruler 400 or due to the user pressing down on the ruler 400 to keep it stationary.

Also, in some embodiments, while in the first configuration disclosed in FIGS. 1B and 1C, the ruler 400 may further extend over the top of the backing pole 106 with the ruler 400 positioned flat against the quilt-top fabric 158. Thus, even where the ruler 400 is too long to fit in a working area of the reconfigurable fabric frame 100 without extending over the top of the backing pole 106, the backing pole 106 may still enable the user to benefit from the assistance of the ruler 400 during operation of the maneuverable sewing machine 300, thereby assisting the user to precisely follow a path where the user desires to form a row of stitches. It is understood that the ruler 400 may have a straight edge or may have an edge that is curved or sinusoidal or any other shape, and the ruler 400 may be positioned at any angle with respect to the backing pole 106.

Further, in some embodiments, while in the first configuration disclosed in FIGS. 1B and 1C, the ruler base 306 may extend forward in front of the maneuverable sewing machine 300, as well as extending outward one on each side of the maneuverable sewing machine 300. Because the ruler base 306 may extend forward in front of the maneuverable sewing machine 300, there may exist a gap between the rear of the backing pole 106 and the needle of the maneuverable sewing machine 300 where a row of stitches cannot be formed due to the ruler base 306 bump against the backing pole 106 forward of the needle of the maneuverable sewing machine 300. Therefore, although the first configuration disclosed in FIGS. 1B and 1C may allow the ruler 400 to extend over the top of the backing pole 106 with the ruler 400 positioned flat against the quilt-top fabric 158, the first configuration may at the same time prevent a row of stitches from being in the gap caused by the forward portion of the ruler base 306. Further, because the ruler base 306 is hidden from the view of the user underneath the layers of fabric, the user may not be able to clearly see the exact boundaries of this gap, and may therefore inadvertently bump the ruler base 306 against the backing pole 106 during operating of the maneuverable sewing machine 300 (whether or not the user is using the ruler 400), which bumping may result in undesired rows of stitches or stitching patterns. Therefore, to the extent that the ruler base 306 extends forward in front of the maneuverable sewing machine 300, a user operating the maneuverable sewing machine 300 while the reconfigurable fabric frame 100 is in the first configuration disclosed in FIGS. 1B and 1C may have to deal the resulting gap where stitches cannot be formed and the resulting inadvertent bumping of the ruler base 306 against the backing pole 106.

Figure 2A:
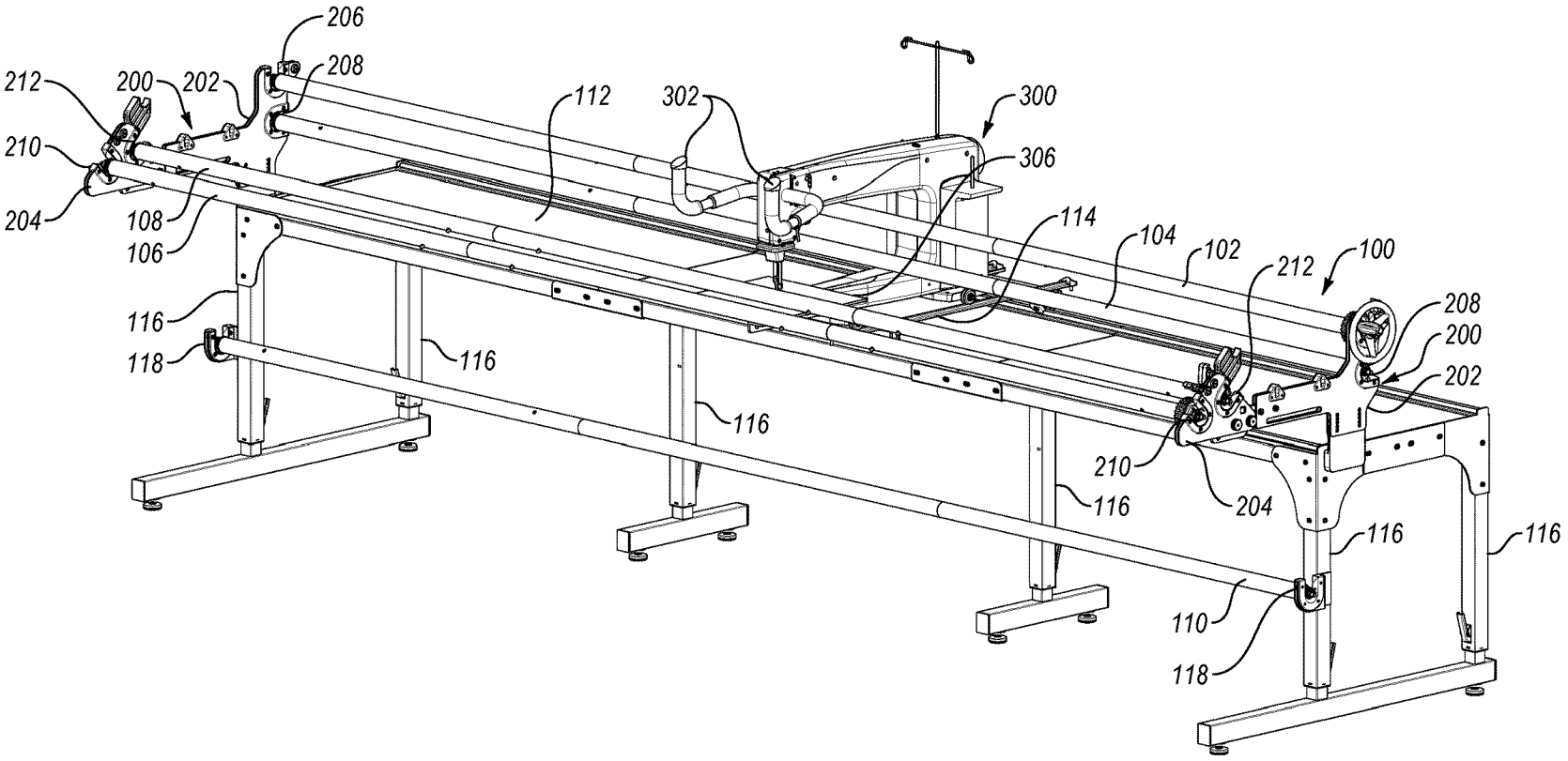
FIG. 2A is a front top perspective view of the example reconfigurable fabric frame of FIG. 1A in a second configuration.
Figure 2B:
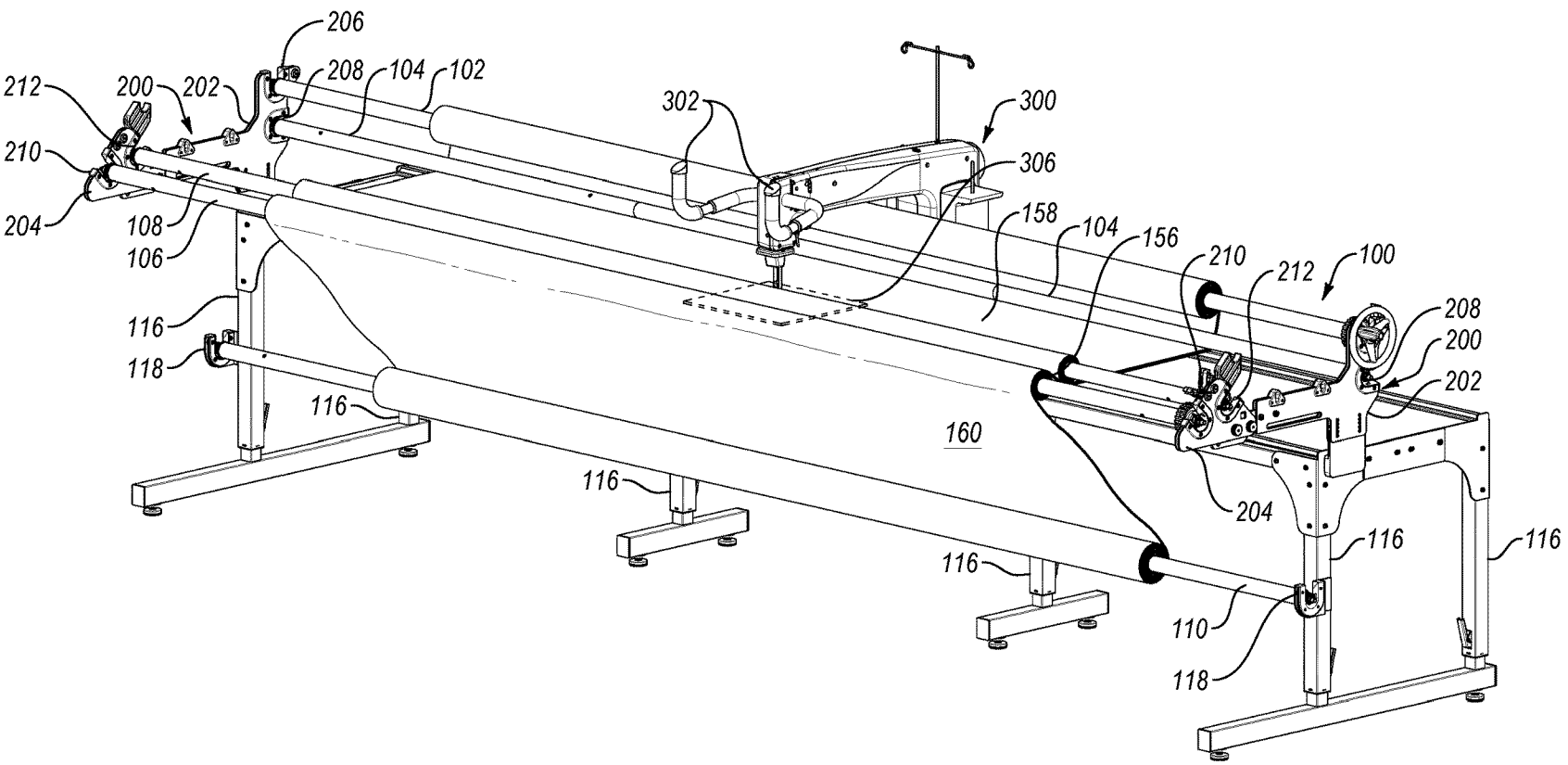
FIG. 2B is a front top perspective view of the example reconfigurable fabric frame of FIG. 2A with fabric spooled thereon.

FIG. 2A is a front top perspective view of the example reconfigurable fabric frame 100 in a second configuration and FIG. 2B is a front top perspective view of the example reconfigurable fabric frame 100 with fabric spooled thereon.

As disclosed in a comparison of FIGS. 1A-1C and FIGS. 2A-2B, the reconfigurable portions 204 of the side rails 200 may be configured, when repositioned from the first configuration of FIGS. 1A-1C to the second configuration of FIGS. 2A-2B, to switch the backing pole attachment locations 210 and the quilt-top pole attachment locations 212. Thus, in the second configuration, the backing pole attachment locations 210 may be lower than the quilt-top pole attachment locations 212.

Further, the backing pole 106 and the quilt-top pole 108 may be configured, when the reconfigurable portions 204 of the side rails 200 are repositioned from the first configuration of FIGS. 1A-1C to the second configuration of FIGS. 2A-2B, to be detached from the reconfigurable portions 204, potentially rotated 180 degrees lengthwise (so that spooled fabric switches from flowing from the front and over the top of the pole to flowing from the front and under the bottom of the pole, and vice versa), and reattached to the switched attachment locations of the reconfigurable portions 204.

In some embodiments, while in the second configuration disclosed in FIG. 2B, a user may be prevented from using the ruler 400 of FIGS. 1B-1C to guide the user in forming a row of stitches along a predetermined path. However, the reconfiguring of the reconfigurable fabric frame 100 into the second configuration may enable the user to sit closer to the working area of the reconfigurable fabric frame 100. Further, the reconfiguring of the reconfigurable fabric frame 100 into the second configuration may enable a forward portion of the ruler base 306 to slide underneath the quilt-top pole 108, which eliminates the gap where stitches cannot be formed, and the bumping of the ruler base 306 against the backing pole 106, that were discussed above in connection with the first configuration of FIGS. 1B and 1C. Also, the reconfiguring of the reconfigurable fabric frame 100 into the second configuration may enable the user to more easily access the bobbin of the maneuverable sewing machine 300 due to the user being able to sit more closely to the working area, the maneuverable sewing machine 300 being able to slide further forward closer to the ruler base 306 being able to slide underneath the quilt-top pole 108, and due to the raised levels of the backing pole 106 and the quilt-top pole 108. Thus, in situations where the user does not desire the assistance of the ruler 400 of FIGS. 1B-1C, the second configuration of the reconfigurable fabric frame 100 disclosed in FIGS. 2A-2B may be desired over the first configuration of the reconfigurable fabric frame 100 disclosed in FIGS. 1A-1C because the second configuration may allow the user to sit closer to the working area of the reconfigurable fabric frame 100, to avoid the bumping of the ruler base 306 against any pole, and to more easily access the bobbin.

Further, in some embodiments, a user may desire to temporarily reposition the reconfigurable portions 204 of the side rails 200 from the first configuration of FIGS. 1A-1C to the second configuration of FIGS. 2A-2B in order to access the bobbin of the maneuverable sewing machine 300, and then promptly reposition the reconfigurable portions 204 of the side rails 200 back to the first configuration. In these embodiments, this temporary repositioning of the reconfigurable portions 204 of the side rails 200 may be accomplished without detaching, switching, and reattaching the backing pole 106 and the quilt-top pole 108, and without unspooling the fabric from these spools.

Figure 3A:
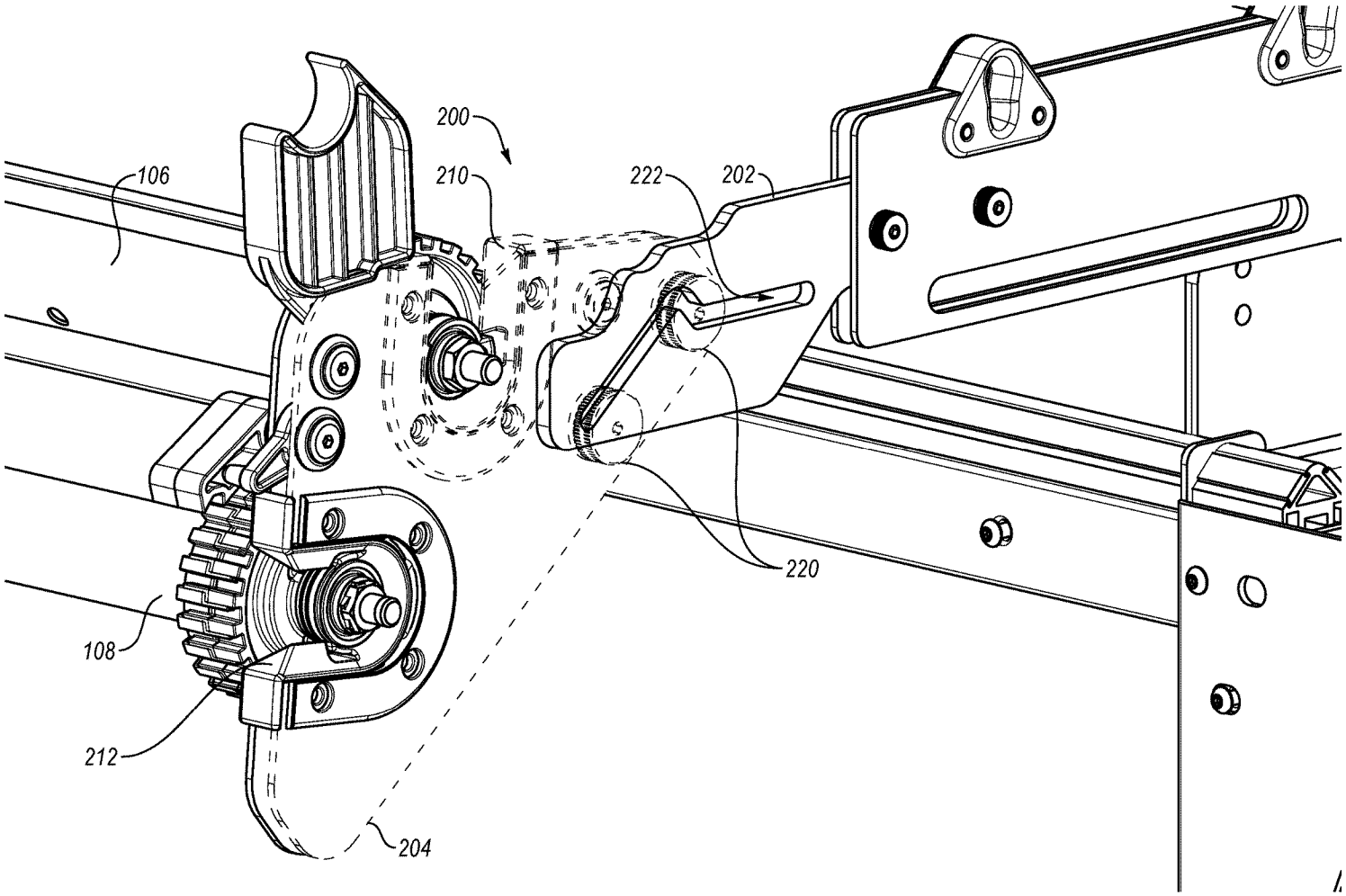
FIG. 3A is a front top perspective view of a stationary portion and a reconfigurable portion of a side rail of the reconfigurable fabric frame of FIG. 1A in the first configuration.
Figure 3B:
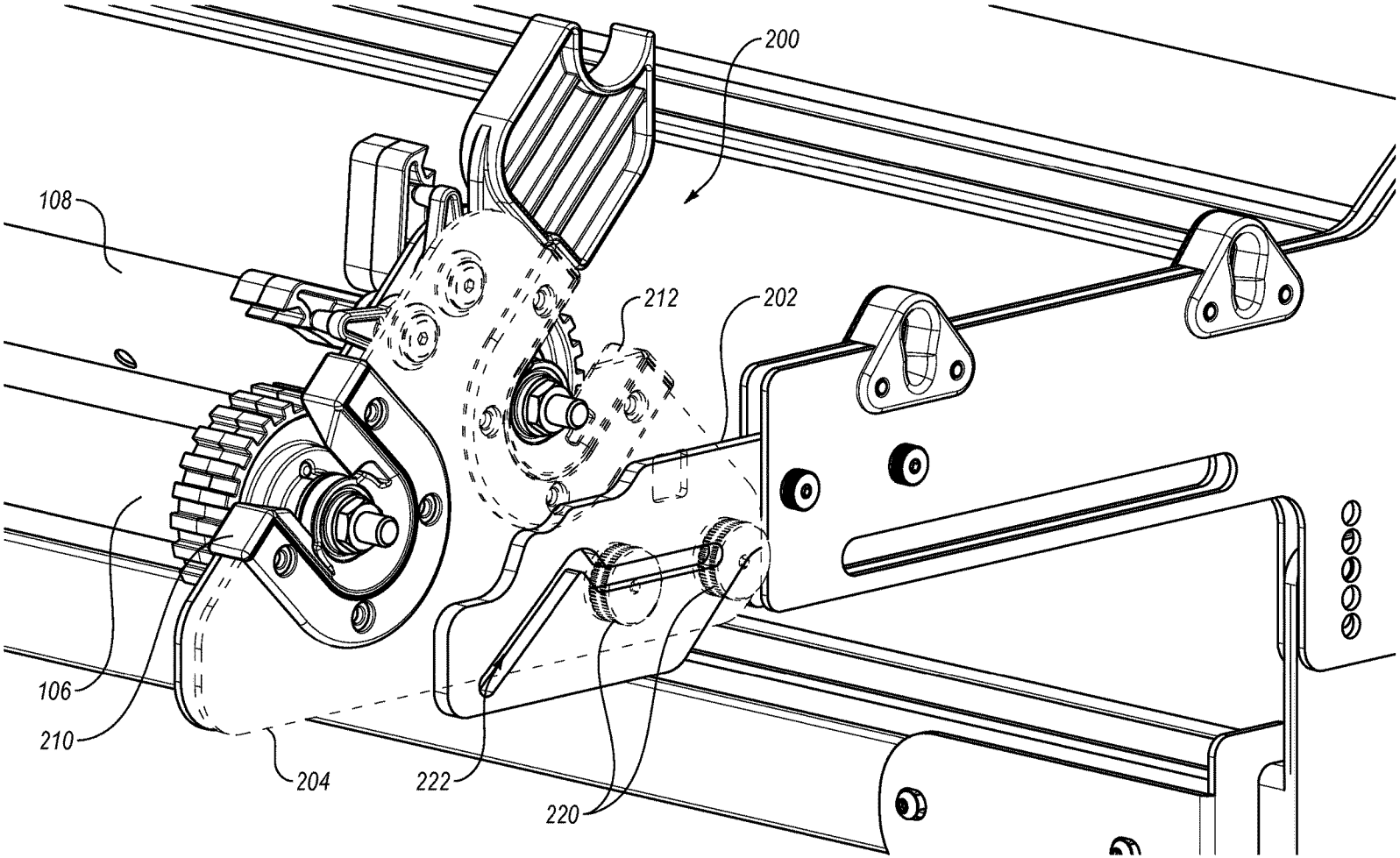
FIG. 3B is a front top perspective view of the stationary portion and the reconfigurable portion of a side rail of the reconfigurable fabric frame of FIG. 2A in the second configuration.

FIG. 3A is a front top perspective view of the stationary portion 202 and the reconfigurable portion 204 of one of the side rails 200 of the reconfigurable fabric frame 100 in the first configuration of FIGS. 1A-1C. FIG. 3B is a front top perspective view of the stationary portion 202 and the reconfigurable portion 204 of one of the side rails 200 of the reconfigurable fabric frame 100 in the second configuration of FIGS. 2A-2B.

As disclosed in FIGS. 3A and 3B, the reconfigurable portion 204 may be configured to be repositioned between the first configuration of FIG. 3A and the second configuration of FIG. 3B. In some embodiments, this repositioning may be accomplished by hand and without the use of any tool. For example, the reconfigurable portion 204 may include hand knobs 220 and the reconfigurable portion 204 may be configured to be repositioned between the first configuration of FIG. 3A and the second configuration of FIG. 3B by manually loosening the hand knobs 220, manually shifting the reconfigurable portion 204 between the first configuration of FIG. 3A and the second configuration of FIG. 3B, and manually tightening the hand knobs 220. The stationary portion 202 may include a slot 222 through which the hand knobs 220 of the reconfigurable portion 204 extend, and manually shifting the reconfigurable portion 204 between the first configuration of FIG. 3A and the second configuration of FIG. 3B may include sliding the hand knobs 220 along the slot 222.

Modifications, additions, or omissions may be made to the reconfigurable fabric frame 100 without departing from the scope of the present disclosure.

For example, in some embodiments, each of the reconfigurable portions 204 may be configured to be repositioned between the first configuration of FIG. 3A and the second configuration of FIG. 3B differently than illustrated in FIGS. 3A and 3B. In particular, one of the hand knobs 220 of each of the reconfigurable portions 204 may be replaced with a pin such that only a single hand knob 220 is employed on each of the reconfigurable portions 204 in repositioning each of the reconfigurable portions 204. Additionally, the remaining hand knob 220 may be replaced with a bolt and nut, a shoulder screw, or other retention mechanism that requires a tool, such as a wrench (or pair of wrenches) or a screw driver, to loosen and tighten. Alternatively, both the hand knobs 220 of each of the reconfigurable portions 204 may be replaced with retention mechanisms that require a tool to loosen and tighten. Additionally or alternatively, the slot 222 of each of the stationary portions 202 may be replaced with a series of holes through which the hand knobs 220, or other retention mechanisms, may extend, which may require the hand knobs 220 or other retention mechanisms to be completely removed in order to reposition the reconfigurable portions 204.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A reconfigurable fabric frame for a maneuverable sewing machine, the reconfigurable fabric frame comprising:

a take-up pole;

an idler pole;

a backing pole;

a quilt-top pole; and side rails including take-up pole attachment locations, idler pole attachment locations, backing pole attachment locations, and quilt-top pole attachment locations formed thereon, the side rails further including stationary portions and reconfigurable portions, the reconfigurable portions of the side rails being configured to be repositioned between:

a first configuration in which the backing pole attachment locations are higher than the quilt-top pole attachment locations; and a second configuration in which the backing pole attachment locations are lower than the quilt-top pole attachment locations.

2. The reconfigurable fabric frame of claim 1, wherein:

the stationary portions include the take-up pole attachment locations and the idler pole attachment locations; and the reconfigurable portions include the backing pole attachment locations and the quilt-top pole attachment locations.

3. The reconfigurable fabric frame of claim 1, wherein the reconfigurable portions are configured to be repositioned between the first configuration and the second configuration by hand and without the use of any tool.

4. The reconfigurable fabric frame of claim 2, wherein the reconfigurable portions are configured, when repositioned between the first configuration and the second configuration, to switch the backing pole attachment locations and the quilt-top pole attachment locations.

5. The reconfigurable fabric frame of claim 4, wherein the backing pole and the quilt-top pole are configured, when the reconfigurable portions are repositioned between the first configuration and the second configuration, to be detached from the reconfigurable portions and reattached to the switched attachment locations of the reconfigurable portions.

6. The reconfigurable fabric frame of claim 1, wherein, while in the first configuration, the top of the backing pole and the bottom of the idler pole form a plane in which a maneuverable sewing machine is configured to sew.

7. A reconfigurable fabric frame for a maneuverable sewing machine, the reconfigurable fabric frame comprising:

a take-up pole;

an idler pole;

a backing pole;

a quilt-top pole; and side rails including take-up pole attachment locations, idler pole attachment locations, backing pole attachment locations, and quilt-top pole attachment locations formed thereon, the side rails further including stationary portions and reconfigurable portions, the reconfigurable portions of the side rails being configured to be repositioned between:

a first configuration in which the backing pole attachment locations are higher than the quilt-top pole attachment locations and in which the top of the backing pole and the bottom of the idler pole form a plane in which a maneuverable sewing machine is configured to sew; and a second configuration in which the backing pole attachment locations are lower than the quilt-top pole attachment locations.

8. The reconfigurable fabric frame of claim 7, wherein:

the stationary portions include the take-up pole attachment locations and the idler pole attachment locations;

the reconfigurable portions include the backing pole attachment locations and the quilt-top pole attachment locations.

9. The reconfigurable fabric frame of claim 7, wherein the reconfigurable portions are configured to be repositioned between the first configuration and the second configuration by hand and without the use of any tool.

10. The reconfigurable fabric frame of claim 8, wherein:

the reconfigurable portions are configured, when repositioned between the first configuration and the second configuration, to switch the backing pole attachment locations and the quilt-top pole attachment locations; and the backing pole and the quilt-top pole are configured, when the reconfigurable portions are repositioned between the first configuration and the second configuration, to be detached from the reconfigurable portions and reattached to the switched attachment locations of the reconfigurable portions.

11. The reconfigurable fabric frame of claim 8, wherein, while in the first configuration, the backing pole is configured to have backing fabric spooled thereon such that the backing fabric flows from the front of the backing pole, over the top of the backing pole, under a hopping foot of the maneuverable sewing machine, and under the bottom of the idler pole.

12. The reconfigurable fabric frame of claim 11, wherein, while in the first configuration, the backing pole is configured to enable a ruler positioned next to the hopping foot of the maneuverable sewing machine to extend over the top of the backing pole with the ruler positioned flat against a top layer of fabric.

13. The reconfigurable fabric frame of claim 12, wherein, while in the second configuration:

the quilt-top pole is configured to have quilt-top fabric spooled thereon such that the quilt-top fabric flows from the front of the quilt-top pole, under the bottom of the quilt-top pole, under a hopping foot of the maneuverable sewing machine, and under the bottom of the idler pole; and the quilt-top pole is configured to prevent a ruler positioned next to the hopping foot of the maneuverable sewing machine from extending over the top of the quilt-top pole with the ruler positioned flat against the quilt-top fabric.

14. The reconfigurable fabric frame of claim 7, wherein the maneuverable sewing machine is a quilting machine.

15. A reconfigurable fabric frame for a maneuverable sewing machine, the reconfigurable fabric frame comprising:

a take-up pole;

an idler pole;

a backing pole;

a quilt-top pole; and side rails including take-up pole attachment locations, idler pole attachment locations, backing pole attachment locations, and quilt-top pole attachment locations formed thereon, the side rails being reconfigurable, by repositioning a reconfigurable portion of each of the side rails by hand and without the use of any tool, between:

a first configuration in which the backing pole attachment locations are higher than the quilt-top pole attachment locations; and a second configuration in which the backing pole attachment locations are lower than the quilt-top pole attachment locations.

16. The reconfigurable fabric frame of claim 15, wherein:

the side rails further include stationary portions;

the stationary portions include the take-up pole attachment locations and the idler pole attachment locations;

the reconfigurable portions include the backing pole attachment locations and the quilt-top pole attachment locations.

17. The reconfigurable fabric frame of claim 15, wherein:

the reconfigurable portions include hand knobs; and the reconfigurable portions are configured to be repositioned between the first configuration and the second configuration by manually loosening the hand knobs, manually shifting the reconfigurable portions between the first configuration and the second configuration, and manually tightening the hand knobs.

18. The reconfigurable fabric frame of claim 17, wherein:

the stationary portions include slots through which the hand knobs of the reconfigurable portions extend; and manually shifting the reconfigurable portions between the first configuration and the second configuration includes sliding the hand knobs along the slots.

19. The reconfigurable fabric frame of claim 16, wherein the backing pole attachment locations and the quilt-top pole attachment locations include ratchets configured to apply tension to backing fabric spooled on the backing pole and to quilt-top fabric spooled on the quilt-top pole.

* * * * *